United States Patent [19]

Salice

[11] 4,050,116

[45] Sept. 27, 1977

[54] SELF-CLOSING HINGE

[75] Inventor: Luciano Salice, Carimate (Como), Italy

[73] Assignee: S.A.R. L. Salice France, Nice, France

[21] Appl. No.: 646,991

[22] Filed: Jan. 7, 1976

[30] Foreign Application Priority Data

Jan. 20, 1975 France ..... 75.01671

[51] Int. Cl.[2] ..... E05D 3/06

[52] U.S. Cl. ..... 16/163; 16/164

[58] Field of Search ..... 16/154, 156, 153, 163, 16/50

[56] References Cited

U.S. PATENT DOCUMENTS

| | | | |
|---|---|---|---|
| 3,362,042 | 1/1968 | Salice | 16/163 |
| 3,724,021 | 4/1973 | Lautenschlaeger | 16/163 |
| 3,772,736 | 11/1973 | Hetlich et al. | 16/163 |
| 3,864,786 | 2/1975 | Salice | 16/163 |
| 3,940,828 | 3/1976 | Lautenschlaeger | 16/163 |

*Primary Examiner*—Werner H. Schroeder
*Assistant Examiner*—Conrad L. Berman
*Attorney, Agent, or Firm*—Wolf, Greenfield & Sacks

[57] ABSTRACT

A self-closing hinge consisting of a device inserted in the fixed fitting of the hinge and achieving the kinematic diagram of a linked and deformable quadrilateral. The hinge consists of a fixed fitting and of a movable fitting connected to each other by two tumblers which constitute with the latter the sides of the linked and deformable quadrilateral. One of the tumblers carries cams on which a spring at least applies through a bent lever and at least a roller.

7 Claims, 11 Drawing Figures

12
11
10
E
A
D
e
d
a

30
D
C

70

F
92
91
90
E
94
93

81
f 80
41
43
40
42
44
A
45
B

21
B
22
20
23
C b
c

SELF-CLOSING HINGE

The present invention relates to a self-closing hinge consisting of a device inserted in the fixed fitting of the hinge and achieving the kinematic diagram of a linked and deformable quadrilateral.

Devices inserted in a hinge and likely to ensure automatic closing of the latter are already known. In particular, devices inserted in the fixed fitting of a hinge are known, said devices consisting of one or more springs which, by means of an element of transmission, act upon a roller in contact with a cam which is a part of a lever: said cam is one of the sides of a lever the opposite side of which consists of a tumbler whose ends are connected to the fixed and movable fittings of the hinge.

Said already known devices are cumbersome and determine the shape and volume of the hinge thus achieved.

The purpose of the present invention is to provide a very compact self-closing hinge which can easily be embedded into fittings, having a great strength, and consisting of a very little quantity of mechanical components, very easy to produce and which can be industrially manufactured.

To this end, the invention relates to a self-closing hinge consisting of a fixed and of a movable fitting connected to each other by means of two tumblers which constitute with the latter the sides of a linked and deformable quadrilateral, one of said tumblers carrying cams upon which at least a spring applies through a bent lever and at least one roller.

According to a further characteristic, the bent lever, movable around an axis of the fixed fitting, applies the roller against the cams of the tumbler.

According to further features, each cam has a constant radius and an arc with a variable radius, and the pressure of the roller onto the section of the cams with a variable radius causes the automatic closing of the hinge.

Thus, the device makes it possible to ensure automatic closing of the hinge when the door it is fitted to is in a position intermediate between opening and closing. Such a position can be elected depending on the shape of the cams.

According to another characteristic, the spring (or the springs) is (or are) located between the roller and the cams of the tumbler.

Thus, such an arrangement makes it possible to achieve a very little cumbersome hinge, in which the components are arranged in a very compact and rational way.

The present invention will be described with more details by means of a mode of embodiment diagrammatically shown in the drawing attached herewith, wherein.

Figures 1, 2, 3, 4, 5, 6, 7, 8, 9:
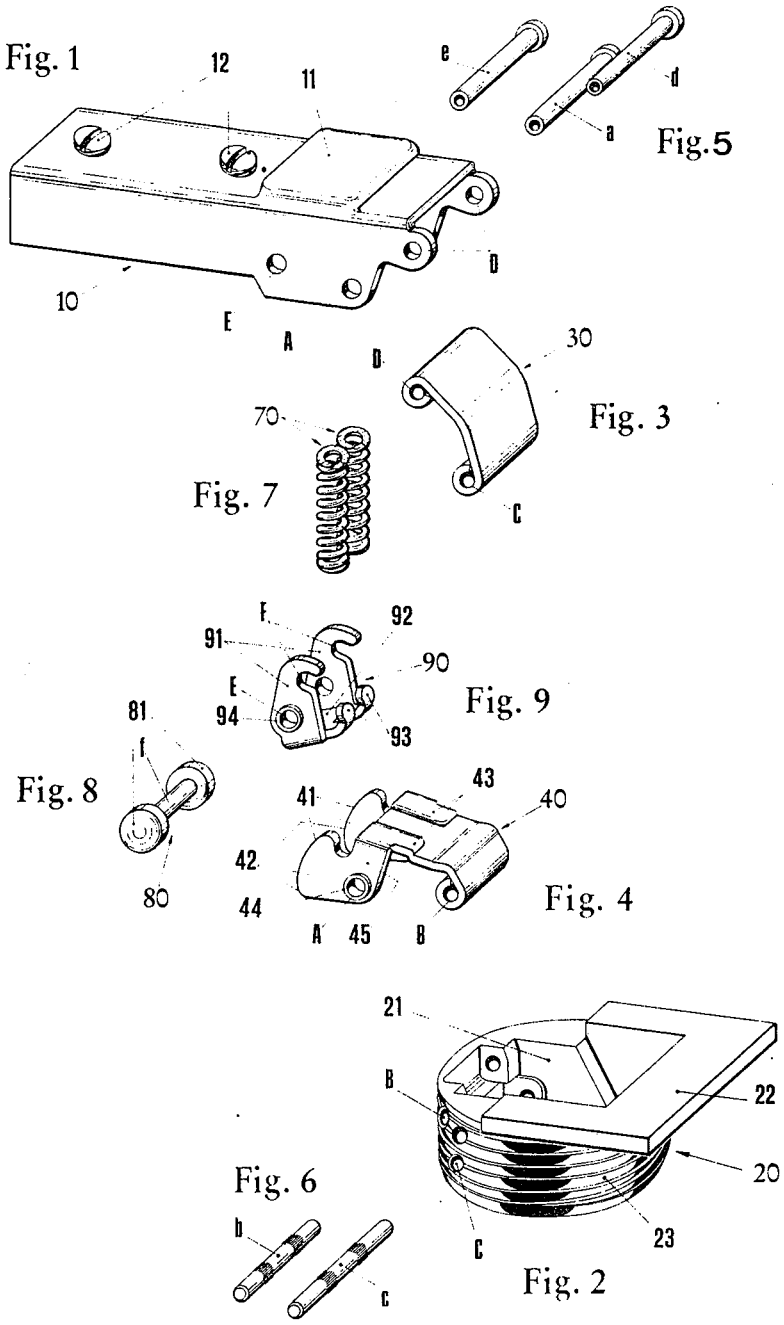
FIGS. 1 to 6 are axonometric views of the various components of a hinge, achieving the kinematic diagram of a linked and deformable quadrilateral, capable to receive the automatic closing device.
FIGS. 7, 8 and 9 are axonometric views of the components constituting the automatic device according to the invention.

More particularly, FIG. 1 shows the fixed fitting of a hinge, designed to be fitted on a door-frame or on the fixed cheek of a piece of furniture.

FIG. 2 shows, by way of example, the movable fitting of the same hinge, designed in particular to be achieved in a plastic material.

FIG. 3 shows one of the two tumblers connecting together the movable and fixed fittings of the hinge.

FIG. 4 shows the other tumbler of the linked and deformable quadrilateral, a tumber carrying two cams, involved in the closing device.

FIGS. 5 and 6 show the pivots of the linked and deformable quadrilateral.

FIG. 7 shows two helicoidal springs of compression.

FIG. 8 shows a double roller.

FIG. 9 shows a double bent lever.

Figure 10:
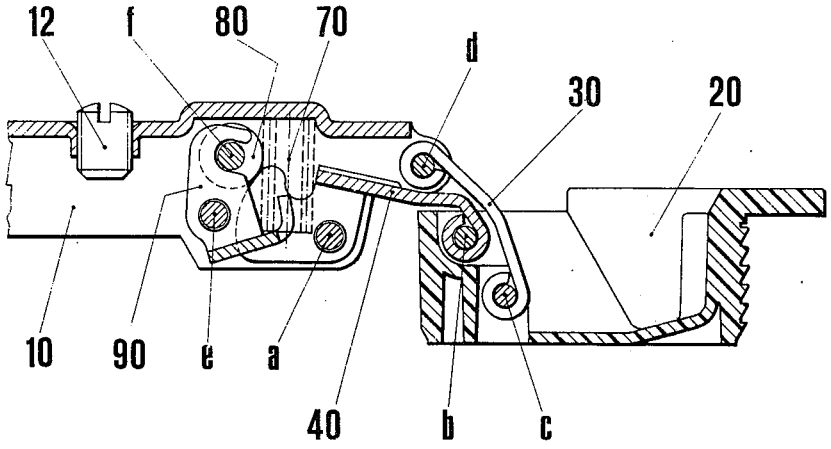
FIGS. 10 and 11 are partial longitudinal cross-section views, in which the hinge carries the self-closing system under two different opening positions.

FIG. 10 is a partial longitudinal cross-section view of the hinge carrying said device, when open at 90°.

Figure 11:
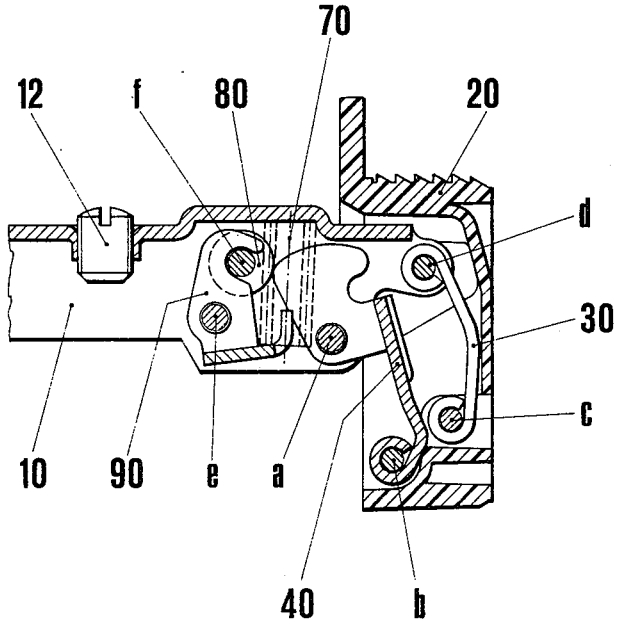

FIG. 11 is a partial cross-section view of the same hinge when closed.

The fixed fitting 10 (FIG. 1) of the hinge has, on its back, an enlargement 11, capable to receive the device subject matter of the present invention; also, it carries perforations A and D, capable to receive the pivots *a* and *d* (FIG. 5) of the linked quadrilateral and the perforations E provided for the pivot *e* of the bent lever.

The movable fitting 20 (FIG. 2) is designed to be embedded into a cylindrical perforation of a door equipped with such a type of hinge; it carries perforations B and C for the pivots *b* and *c* FIG. 6), a cavity 21 in which the end of the fixed fitting 10 penetrates when the hinge closes, a strap 22 limiting penetration of the fitting 20 into its recess, a threading 23 ensuring close connection of said fitting with the door in which it is embedded.

The tumbler 30 carries two windings D and C forming knuckles inside which the pivots *d* and *c* are introduced.

The tumbler 40 carries a winding B forming a knuckle for the pivot *b* and two perforations A reinforced by a bearing 44 inside which the pivot *a* rotates; the back of said tumbler has an inertia reinforced by two stamps 43, and its sides 45 extend so as to form two cams which have a constant radius at their upper portion 41, while they have a decreasing radius at their lower portion 42.

The double roller 80 consists of two cylindrical rollers 81 coaxially connected to each other by an axis *f*.

The bent layer 90 consists of two sides 91, connected together by an intermediate plate 92, said two sides carrying two perforations E, reinforced by a bearing 94, inside which the pivot *e* passes; two hooks F receive the axis *f* of the double roller 80, two stops 93 protrude from the plate 92 and serve to catch the two springs 70.

When the hinge is open (FIG. 10), the springs 70 make the lever 90 press the double roller 80 against the cams of the tumber 40; but, as the roller acts upon the portion 41 of the cams with a constant radius, no couple of rotation is transmitted to the linked quadrilateral and no closing or opening motion are transmitted to the hinge.

When the hinge is close to its closing position (FIG. 11), the springs 70 push the rollers 80 against the parts 42 of the cams with a decreasing radius by means of the lever 90 and, thus, the tumbler 40 is attracted by a couple which tends to close the hinge and also the door it is integral with; on the contrary, a rather great strength must be exerted to reopen the door, because this necessitates the roller 80 to raise on the portion of the cams with an increasing radius, by compressing both springs 70.

What we claim is:

1. A self-closing hinge mechanism having a fixed portion adapted to be mounted to a fixed member and a movable portion adapted to be mounted to a movable member for movement therewith comprising:

a pair of links, each pivotally connected by points to each of the fixed portion and movable portion to define a quadrilateral link mechanism;

a first of said links including cam means extending from that end of the first link which is adjacent its pivot to the fixed member;

a bellcrank pivotally mounted at a point between its ends to the fixed member;

roller means rotatably carried by one end of the bellcrank;

spring means in engagement with the other end of the bellcrank to bias the bellcrank in a direction which will cause engagement of the roller means with the cam means.

2. A self-closing hinge-mechanism as defined in claim 1 further comprising:

said roller means and the location of engagement of the spring means with said bellcrank being spaced equidistant from the pivot for said bellcrank.

3. A self-closing hinge mechanism as defined in claim 1 further comprising:

said spring means being disposed within the fixed portion at a location between said bellcrank and said pivot for said cam means.

4. A self-closing hinge mechanism as defined in claim 1 further comprising:

said cam means having a constant radius arc throughout its range of travel corresponding to the open position of the hinge.

5. A self-closing hinge mechanism as defined in claim 1 further comprising:

said fixed member including an internal recess formed therein to receive and engage one end of the spring; and said bellcrank including finger means at its spring-engaged end to be received in an end of said spring.

6. A self-closing hinge mechanism as defined in claim 1 further comprising:

said first link having a pair of transversely spaced, identical cams; and said roller means including a pair of rollers, each being located to engage one of the cams.

7. A self-closing hinge mechanism as defined in claim 6 further comprising:

said spring means being located transversely between said cams.

* * * * *